US006651532B1

(12) United States Patent
Whitelock et al.

(10) Patent No.: US 6,651,532 B1
(45) Date of Patent: Nov. 25, 2003

(54) DRIVABLE SOCKET WRENCH

(76) Inventors: Darcy L. Whitelock, R. R. #1, Hardisty, Alberta T0B-1V0 (CA); Leah C. Whitelock, R. R. #1, Hardisty, Alberta T0B-1V0 (CA)

( * ) Notice: Subject to any disclaimer, the term of this patent is extended or adjusted under 35 U.S.C. 154(b) by 62 days.

(21) Appl. No.: 10/038,357

(22) Filed: Jan. 7, 2002

(51) Int. Cl.[7] ..... B25B 17/00
(52) U.S. Cl. ..... 81/57.29; 81/57.26
(58) Field of Search ..... 81/57.29, 57.26, 81/60

(56) References Cited

U.S. PATENT DOCUMENTS 4,003,275 A 1/1977 Smith
4,242,931 A 1/1981 Clement
5,584,220 A * 12/1996 Darrah et al. ..... 81/57.29
5,630,343 A * 5/1997 Begin ..... 81/57.46
5,784,934 A * 7/1998 Izumisawa ..... 81/57.26
5,927,156 A 7/1999 Landwehr, III
6,435,060 B1 * 8/2002 Izumisawa ..... 81/57.39

* cited by examiner

*Primary Examiner*—Lee D. Wilson
(74) *Attorney, Agent, or Firm*—Donald R. Schoonover

(57) ABSTRACT

A socket wrench is adjustable to have a plurality of degrees of freedom and can be adjustable in a plurality of planes includes a handle unit that is movable longitudinally on a shaft unit and a drive head unit that is pivotally movable on the shaft unit. The shaft unit includes shafts that are triangular in cross sectional shape.

11 Claims, 3 Drawing Sheets

DRIVABLE SOCKET WRENCH

BACKGROUND OF THE INVENTION

1. Field of the Invention

The present invention relates to the general art of tools, and to the particular field of wrenches.

2. Discussion of the Related Art

Often, a worker will encounter workpieces, such as bolts, nuts or the like, that are located in positions that make them extremely difficult to remove or place. For example, a bolt may be underneath another part that blocks access to the bolt or inhibits movement of a wrench or tool used to move the workpiece in a manner necessary to the operation. This makes removal or installation of certain workpiece difficult and time consuming.

It is often necessary to remove other parts to gain access to the workpiece of interest with a wrench, such as an open-end wrench or a box-end wrench or the like.

Therefore, there is a need for a wrench that can expeditiously reach and remove workpiece that are located in difficult to reach locations.

A socket wrench often requires that the handle be moved back and forth to remove or place a workpiece. If the workpiece is in a difficult-to-access location, this operation may be difficult or impossible.

Therefore, there is a need for a socket wrench that can operate on workpiece even if the workpiece is located in a position that makes back and forth movement of the wrench difficult or impossible.

Still further, many workpiece are located in positions that can only be reached by using an extension. Therefore, any socket wrench that is used for such workpiece should be amenable for use with an extension.

Often, one workpiece may be in a location that is reachable with a socket wrench having a handle of a certain length, but not of another length. In such cases, a worker may need several wrenches, which can be expensive and time consuming.

Therefore, there is a need for a socket wrench that is amenable to adapting different handle lengths.

Still further, many workpiece require a great deal of torque to move them, especially if the workpiece is rusted. Any socket wrench used on such workpiece must be amenable to accepting and applying a great deal of torque without damaging the wrench. This problem is exacerbated if the wrench is not easy to securely grasp. That is, if the wrench slips from the user's grip during use, the wrench can be damaged, and perhaps lost.

Therefore, there is a need for a socket wrench that can accept and deliver a great deal of torque without damage to the wrench. There is still further need for a socket wrench that can be securely gripped during use, even when a great deal of torque is being applied to the wrench.

It is also observed that even with an extension, some workpiece may be located in positions that are so odd that even an extended socket wrench may not be able to easily reach the workpiece. Therefore, there is a need for a socket wrench that is not only extendable but can be modified to reach workpiece in odd locations, such as may require adjustment of the wrench in a plurality of planes or has a plurality of degrees of freedom.

PRINCIPAL OBJECTS OF THE INVENTION

It is a main object of the present invention to provide a wrench that can expeditiously reach and remove workpiece that are located in difficult to reach locations.

It is another object of the invention to provide a socket wrench that can expeditiously reach workpiece to which access is limited.

It is another object of the present invention to provide a socket wrench that can easily accommodate an extension handle.

It is another object of the present invention to provide a socket wrench that has an adjustable handle so fine adjustments can be made in an expeditious manner.

It is another object of the present invention to provide a socket wrench that can accommodate high torque without being damaged.

It is another object of the present invention to provide a socket wrench that is adjustable in a plurality of planes.

It is another object of the present invention to provide a socket wrench that is adjustable in a plurality of degrees of freedom.

It is another object of the present invention to provide a socket wrench that is easily grasped and securely held.

SUMMARY OF THE INVENTION

These, and other, objects are achieved by a socket wrench that has a handle unit that is movably mounted on a shaft unit and a drive head unit that is movably mounted on the shaft unit to move in a direction or plane that is different from the direction or plane in which the handle unit moves. That is, the wrench has a plurality of degrees of freedom or can move in multiple planes. The shaft unit includes shafts that are shaped to accept torque without slipping and torque applied to the socket wrench can be directed or re-directed as necessary to reach workpiece in odd locations and/or positions. The handle unit can accept an extension if necessary. The handle unit includes knurling so it can be securely gripped.

DETAILED DESCRIPTION OF THE INVENTION

Figure 1:
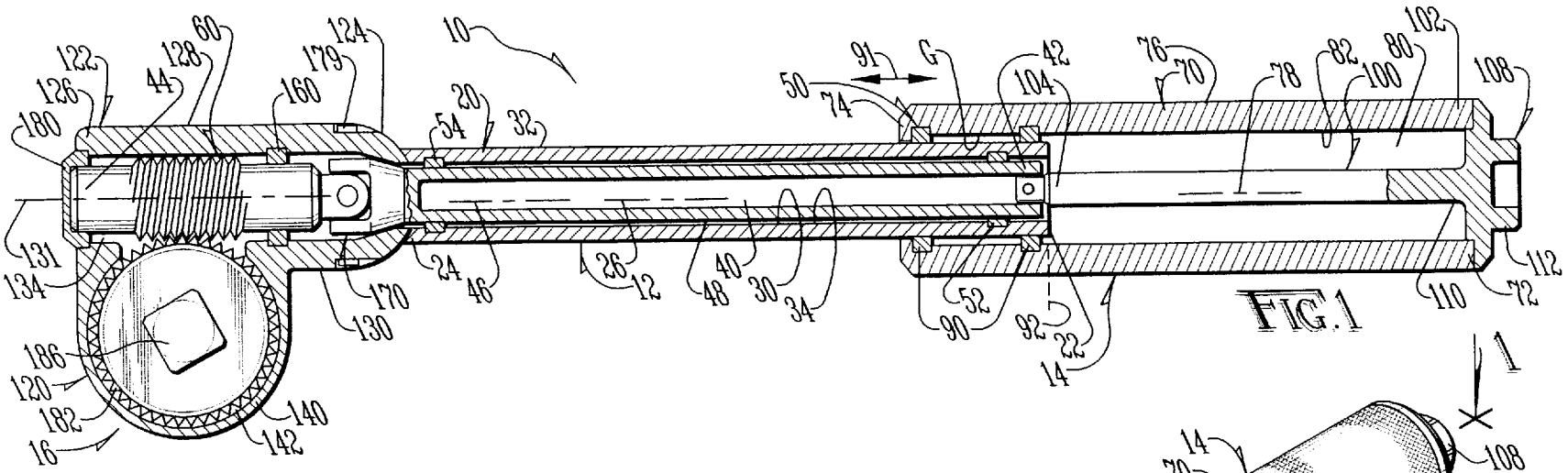
FIG. 1 is a side elevational cut away view of a drivable socket wrench embodying the teaching of the present invention.
Figure 1A:
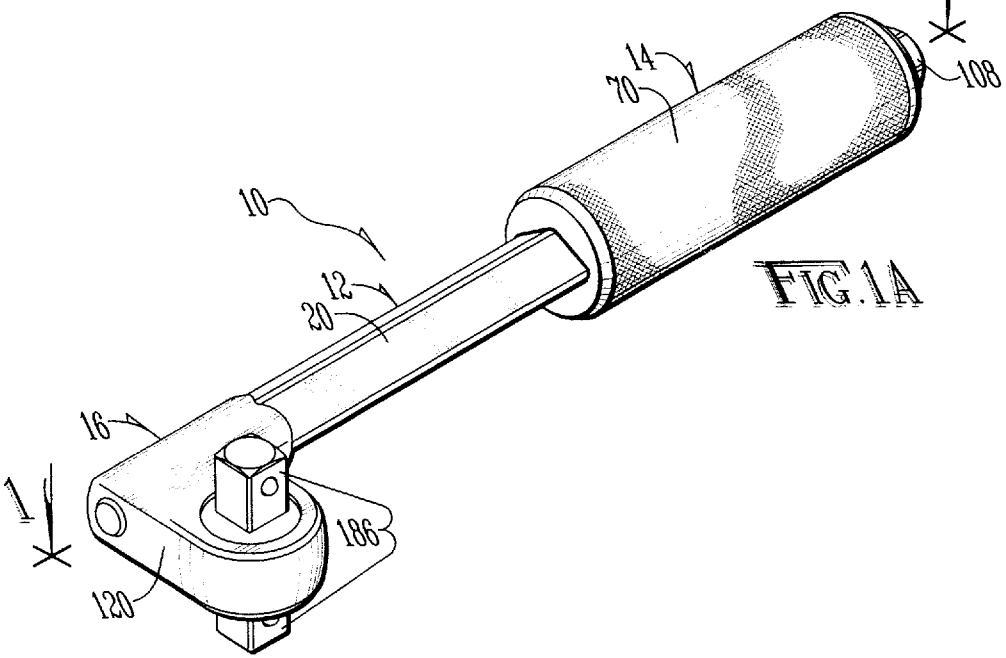
FIG. 1A is a reduced perspective view showing the drivable socket wrench with a triangular shaft.

Other objects, features and advantages of the invention will become apparent from a consideration of the following detailed description and the accompanying drawings.

Referring to FIGS. 1–4 an embodiment of the wrench of the present invention is shown as wrench 10. Wrench 10 permits operation of fasteners that are located in hard-to-reach positions and to operate those fasteners in an expeditious manner.

As shown in FIGS. 1–4, wrench 10 includes a shaft unit 12, a handle unit 14, and a drive head unit 16 which cooperate to permit operation of a fastener that may be located in an inaccessible position.

Shaft unit 12 includes an outer shaft 20 having a first end 22, a second end 24, a longitudinal dimension 26 extending between first end 22 and second end 24 of outer shaft 20. A bore 30 extends along longitudinal dimension 26 of outer shaft 20 from first end 22 of outer shaft 20 to second end 24 of outer shaft 20. Outer shaft 20 further includes an outer surface 32 and an inner surface 34 located adjacent to bore 30 of outer shaft 20.

Shaft unit 12 further includes an inner shaft 40 having a first end 42, a second end 44, a longitudinal dimension 46 extending from first end 42 of inner shaft 40 to second end 44 of inner shaft 40 and is coincident with longitudinal dimension 26 of outer shaft 20. Inner shaft 40 further includes an outer surface 48 which is spaced from inner surface 34 of outer shaft 20.

Figure 2:
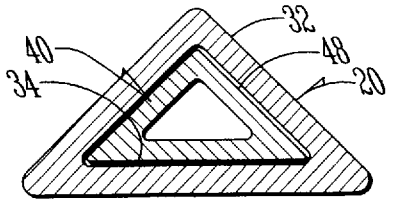
FIG. 2 is a cross sectional view of a drive shaft unit of the drivable socket wrench embodying the teaching of the present invention showing the triangular cross sectional shape of shafts thereof.

Shaft unit 12 further includes bushings 50 connecting inner surface 34 of outer shaft 20 to outer surface 48 of inner shaft 40 so rotation of outer shaft 20 is transmitted to inner shaft 40 when outer shaft 20 is rotated. Bushings 50 include a first bushing 52 located adjacent to first end 42 of inner shaft 40 and a second bushing 54 located adjacent to second end 24 of outer shaft 20. As shown in FIG. 2, inner shaft 40 and outer shaft 20 are both triangular in cross sectional shape. A worm gear 60 is positioned on inner shaft 40 adjacent to second end 44 of inner shaft 40 and is oriented to rotate with inner shaft 40 when inner shaft 40 rotates about longitudinal dimension 46 of inner shaft 40. In one form of the wrench 10, bushings 50 are formed of nylon.

The operation and function of shaft unit 12 will be understood from the teaching of this disclosure.

As shown in FIG. 1, handle unit 14 includes a body 70 having a first end 72, a second end 74, an outside surface 76, and a longitudinal dimension 78 extending between first end 72 of body 70 of handle unit 14 and second end 74 of body 70 of handle unit 14. A bore 80 extends along longitudinal dimension 78 of body 70 of handle unit 14 from first end 72 of body 70 of handle unit 14 to second end 74 of body 70 of handle unit 14. Body 70 further includes an inside surface 82 of body 70 of handle unit 14 adjacent to bore 80 of body 70 of handle unit 14.

Handle unit 14 further includes bushings 90 slidably connecting body 70 of handle unit 14 to outer shaft 20 of shaft unit 12 so outer shaft 20 rotates with body 70 of handle unit 14 when body 70 of handle unit 14 is rotated. Bushings 90 are received in grooves G defined in surface 82 of body 70 and body 70 of handle unit 14 is slidable along outer shaft 20 in the direction of longitudinal dimension 46 of outer shaft 20 as indicated by double-headed arrow 91 in FIG. 1. In one form of the wrench, bushings 90 are formed of brass. Body 70 is slidable between a first position shown in FIG. 1 with second end 74 of body 70 of handle unit 14 located adjacent to first end 22 of outer shaft 20 to a second position indicated by dotted line 92 in FIG. 1 with first end 72 of body 70 of handle unit 14 located adjacent to first end 22 of outer shaft 20. As shown in FIG. 1, bushings 90 of handle unit 14 are located adjacent to first end 22 of outer shaft 20.

Handle unit 14 further includes a drive shaft 100 located in bore 80 of body 70 of handle unit 14 and includes a first end 102 located adjacent to second end 74 of body 70 of handle unit 14, and a second end 104 connected to first end 42 of inner shaft 40 of drive unit 12 so inner shaft 40 of shaft unit 12 rotates with drive shaft 100 of handle unit 14 when drive shaft 100 of handle unit 14 is rotated.

Figure 3:
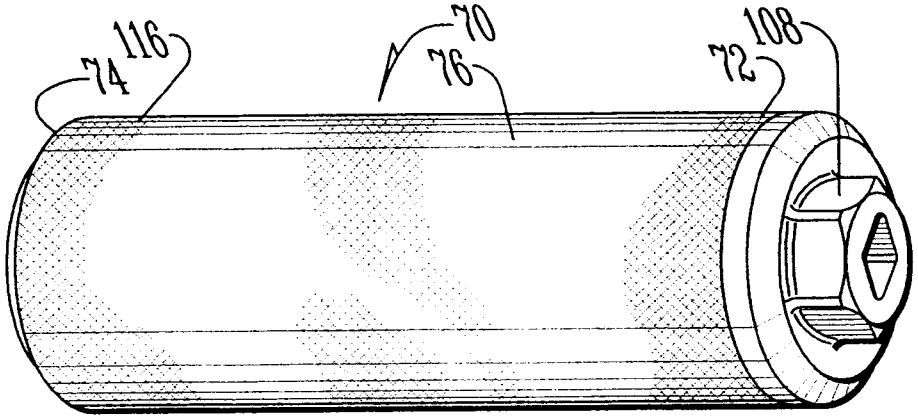
FIG. 3 is a perspective view of a handle unit of the drivable socket wrench of the present invention.

As shown in FIGS. 1 and 3, a drive socket 108 is rotatably mounted on first end 72 of body 70 of handle unit 14 and includes a first end 110 located inside bore 80 of body 70 of handle unit 14 and is connected to first end 102 of drive shaft 100 of handle unit 14 so drive shaft 100 of handle unit 14 rotates with drive socket 108 when drive socket 108 is rotated. Rotation of drive socket 108 can be effected using a socket wrench or an extension from a socket wrench or the like. Drive socket 108 further includes a second end 112 located adjacent to second end 72 of body 70 of handle unit 14. Second end 112 of drive socket 108 is located outside bore 80 of body 70 of handle unit 14. In the form shown, drive socket 108 is a square female element.

Knurling 116 is located on outside surface 76 of body 70 of handle unit 14 so a user can easily grasp handle unit 14 and torque can be applied thereto.

Figure 4:
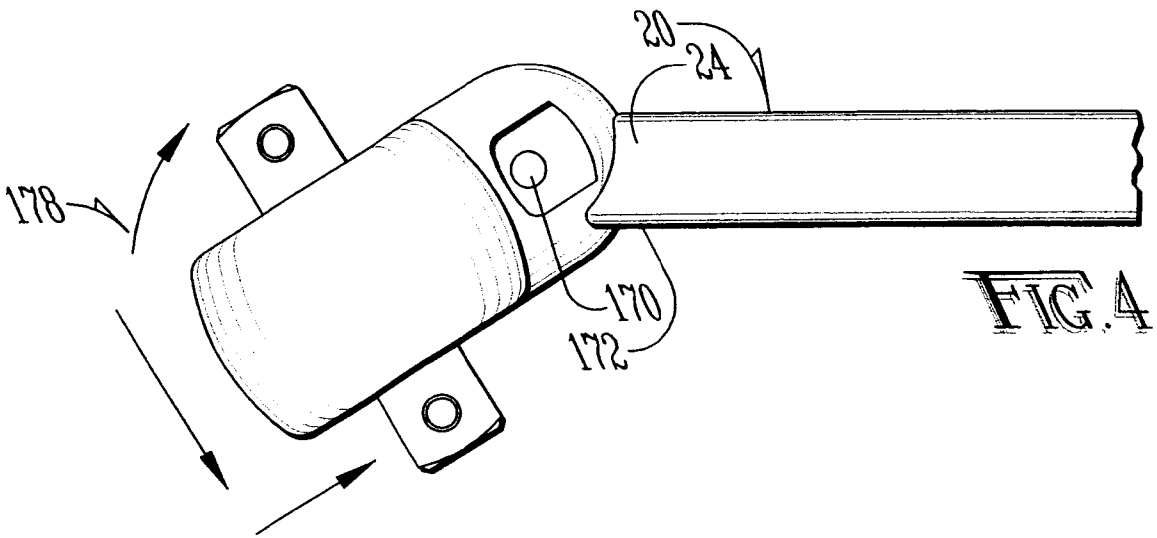
FIG. 4 is a top view of the drivable socket wrench of the present invention illustrating the pivotal movement of a head unit thereof.

Drive head unit 16 is shown in FIGS. 1 and 4 and includes a body 120 having a first portion 122 which includes a first end 124, a second end 126, and first and second sides 128 and 130 connecting first end 124 of first portion 122 of body 120 of drive head unit 16 to second end 126 of first portion 122 of body 120 of drive head unit 16. A longitudinal 131 dimension extends between first end 124 of first portion 122 of body 120 of drive head unit 16 to second end 126 of first portion 122 of body 120 of drive head unit 16. Drive head unit 14 further includes a bore 134 extending along longitudinal dimension 131 of first portion 122 of body 120 of drive head unit 16 from first end 124 of first portion 122 of body 120 of drive head unit 16 to second end 126 of first portion 122 of body 120 of drive head unit 16.

Drive head unit 16 further includes a second portion 140 on second side 130 of first portion 122 of body 120 and which includes an inner chamber 142. As can be seen in FIG. 1, inner shaft 40 of shaft unit 12 extends into bore 134 of first portion 122 of body 120 of drive unit 16 and is mounted for rotation in first portion 122 of body 120 of drive unit 16. Worm gear 60 is positioned on inner shaft 40 of drive shaft unit 12 to be located inside bore 134 of first portion 122 of body 120 of drive head unit 16.

Drive head unit 16 further includes bushings 160 connecting inner shaft 40 of shaft unit 12 to body 120 of first portion 122 of drive head unit 16 in a manner that permits inner shaft 40 of shaft unit 12 to rotate with respect to first portion 122 of body 120 of drive head unit 16. Second end 24 of outer shaft 20 of shaft unit 12 is located adjacent to first end 124 of body 120 of first portion 122 of drive head unit 16.

As shown in FIGS. 1 and 4, a pivot joint 170 connects first portion 122 of body 120 of drive head unit 16 to inner shaft 40 of shaft unit 12 in a manner which permits inner shaft 40 of shaft unit 16 to rotate with respect to first portion 122 of body 120 of drive head unit 16 and permits first portion 122 of body 120 of drive head unit 16 to pivot with respect to inner shaft 40 of shaft unit 12 between a first position having first side 128 of first portion 122 of body 120 of drive head unit 16 located adjacent to one portion of outer shaft 20 of shaft unit 12 and a second position having second side 130 of the first portion 122 of body 120 of drive head unit 16 located adjacent to a second portion 172 of outer drive shaft 20 of shaft unit 16. The first portion of outer drive shaft 20 of shaft unit 12 is spaced apart from second portion 172 of outer drive shaft 20 of shaft unit 12. First portion 122 of body 120 of drive head unit 16 pivots about an axis that is perpendicular to a plane containing outer shaft 20 of shaft unit 12. This permits head unit 16 to move in a direction by pivoting, that differs from the rotational movement of the inner shaft, thus providing a plurality of degrees of freedom to the wrench. When the drive head is offset from the shaft unit, the plane of the drive head unit differs from the plane containing shaft unit 12 thereby providing a plurality of planes in which the wrench can operate. Pivoting movement of head unit 16 with respect to shaft unit 12 is illustrated in FIG. 4 by double-headed arrow 178 and can cover an arc angle of 90 arc-degrees. Pivot pins 179 are also included on drive head unit 16 and can be used to control the pivoting movement and the total amount of pivotal movement of the drive head unit by contacting various pivot pin accommodating dimples, such as dimple D, defined in the outer shaft.

Drive head unit 16 further includes a bushing 180 on second end 126 of the first portion 122 of body 120 of drive head unit 16 and engages second end 44 of inner shaft 40 of shaft unit 12. As shown in FIG. 1, drive head unit 16 further includes a toothed gear 182 in inner chamber 142 of second portion 140 of body 120 of drive head unit 16 and is positioned to engage worm gear 60 of shaft unit 12 for rotation therewith when worm gear 60 rotates. Toothed gear 182 of drive head unit 16 has an axis of rotation that is perpendicular to a plane containing inner shaft 40 of shaft unit 12. Drive head unit 16 further includes a socket connector 186 fixedly connected to toothed gear 182 of drive head unit 16 for rotation therewith when toothed gear 182 rotates. In the form shown, socket connector 186 is a square male element.

Thus, rotation of drive socket 186 can be effected by rotating body 70 of handle unit 14 to rotate outer shaft 20, which, in turn, rotates inner shaft 40 through bushings 50 and 90, which, in turn, rotates worm gear 60, which, in turn, rotates toothed gear 182, which, in turn, rotates drive socket 186. Rotation of drive socket 186 can also be effected by attaching a driving tool to socket 108, which will rotate drive shaft 100, which, in turn, rotates inner drive shaft 40. Handle unit 14 can be adjusted in longitudinal direction 91 and drive head unit 16 can be adjusted in direction 178 to add versatility to wrench 10.

Figure 7:
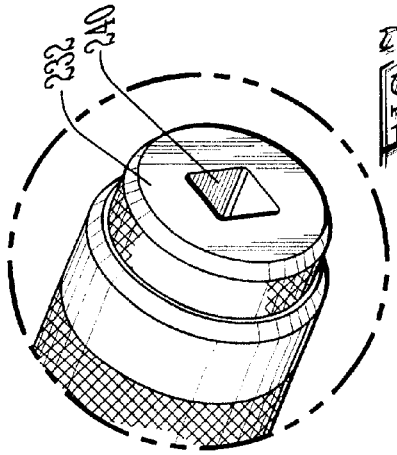
FIG. 7 is a perspective view of a portion of the handle unit of drivable socket wrench shown in FIG. 5.
Figure 6:
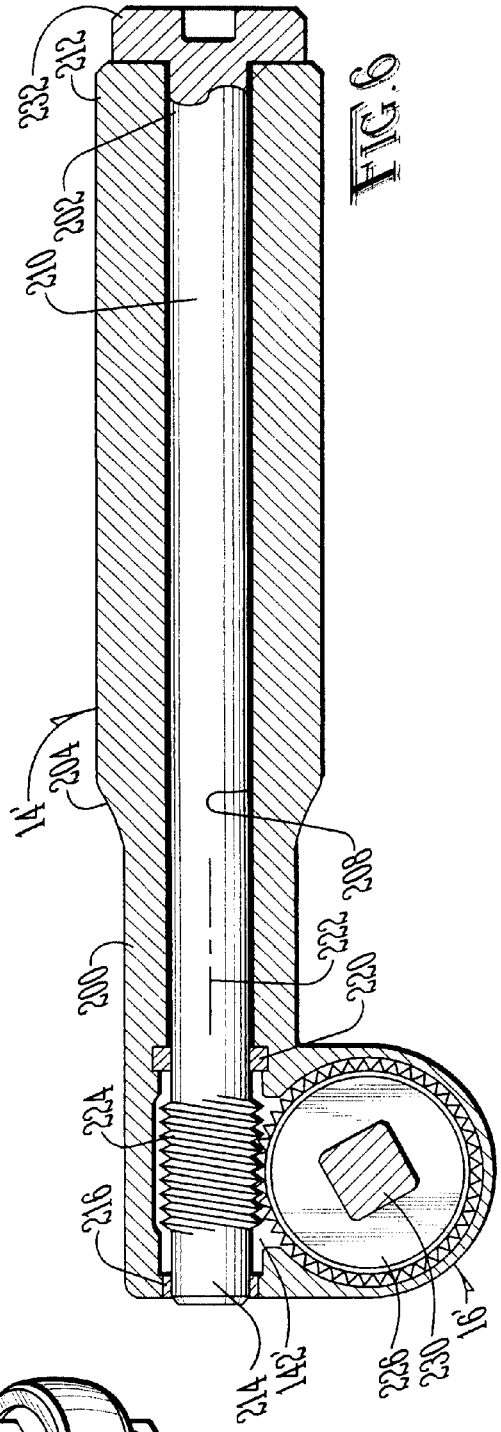
FIG. 6 is a cross-sectional view of the drivable socket wrench taken along line 6—6 of FIG. 5.
Figure 5:
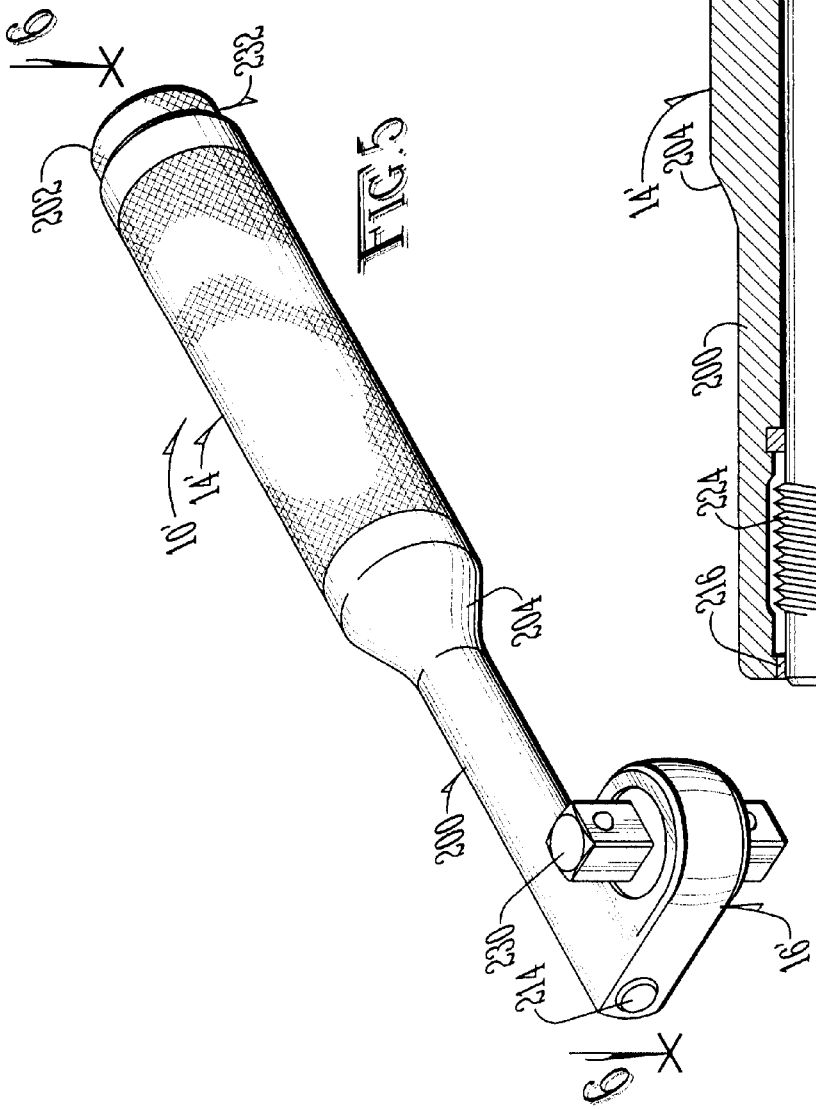
FIG. 5 is a perspective view of another form of the drivable socket wrench of the present invention.

Another form of the wrench of the present invention is shown in FIGS. 5–7 as wrench 10'. Wrench 10' is not adjustable in a plurality of planes as is wrench 10 but is useful in some situations. Wrench 10' is monolithic and includes a handle unit 14' connected to a drive head unit 16' by a shaft 200. As can be seen in FIG. 5, handle unit 14' includes knurling on the outside surface thereof, and has a first end 202 and a second end 204, with end 204 tapering to shaft 200. A longitudinally extending bore 208 extends from first end 202 through handle unit 14', shaft unit 200 and through drive head unit 16' which has a chamber 142' defined therein. A drive shaft 210 has a first end 212 located adjacent to first end 202 of handle unit 14' and a second end 214 rotatably received in a bushing 216 mounted on drive head unit 16'. A further bushing 220 mounts drive shaft 210 in shaft unit 200 for rotation about longitudinal centerline 222 of shaft 210. A worm gear 224 is fixed to shaft 210 for rotation therewith, and a toothed gear 226 is mounted in chamber 142' of drive head unit 16' to drivingly engage worm gear 224 to be driven thereby. A drive socket 230 is fixed to toothed gear 226 for rotation therewith.

A finger grip 232 is fixedly mounted on shaft 210 adjacent to first end 212 thereof which extends outside of bore 208 adjacent to end 202 of handle unit 14'. Rotation of finger grip 232 rotates shaft 210, which, in turn, rotates worm gear 224, which, in turn, rotates toothed gear 226, which, in turn, rotates drive socket 230. Thus, rotation of finger grip 232 is transferred to drive socket 230 by wrench 10'. A square female socket 240 is located in finger grip 232 so a further socket driving wrench or tool can be drivingly connected to shaft 210 via finger grip 232 if desired. Thus, wrench 10' can be operated using a power tool or by simply turning finger grip 232 by hand.

It is understood that while certain forms of the present invention have been illustrated and described herein, it is not to be limited to the specific forms or arrangements of parts described and shown.

We claim:

1. A wrench comprising:

a) a shaft unit which includes
  (1) an outer shaft having
    (A) a first end,
    (B) a second end,
    (C) a longitudinal dimension extending between the first end and the second end of the outer shaft,
    (D) a bore extending along the longitudinal dimension of the outer shaft from the first end of the outer shaft to the second end of the outer shaft,
    (E) an outer surface, and
    (F) an inner surface located adjacent to the bore of the outer shaft,
  (2) an inner shaft having
    (A) a first end,
    (B) a second end,
    (C) a longitudinal dimension extending from the first end of the inner shaft to the second end of the inner shaft, and
    (D) an outer surface,
  (3) bushings connecting the inner surface of the outer shaft to the outer surface of the inner shaft so rotation of the outer shaft is transmitted to the inner shaft when the outer shaft is rotated, said bushings including a first bushing located adjacent to the first end of said inner shaft and a second bushing located adjacent to the second end of said outer shaft,
  (4) said inner shaft and said outer shaft both being triangular in cross sectional shape, and
  (5) a worm gear on said inner shaft adjacent to the second end of said inner shaft and oriented to rotate with said inner shaft as said inner shaft rotates about the longitudinal dimension of said inner shaft;

b) a handle unit which includes
  (1) a body having
    (A) a first end,
    (B) a second end,
    (C) an outside surface,
    (D) a longitudinal dimension extending between the first end of the body of said handle unit and the second end of the body of said handle unit,
    (E) a bore extending along the longitudinal dimension of the body of said handle unit from the first end of the body of said handle unit to the second end of the body of said handle unit,
    (F) an inside surface of the body of said handle unit adjacent to the bore of the body of said handle unit,
  (2) bushings slidably connecting the body of said handle unit to the outer shaft of said shaft unit so said outer shaft rotates with the body of said handle unit as the body of said handle unit is rotated, the body of said handle unit being slidable along the outer shaft in the direction of the longitudinal dimension of said outer shaft between a first position with the second end of the body of said handle unit located adjacent to the first end of said outer shaft to a second position with the first end of the body of said handle unit located adjacent to the first end of the outer shaft, the bushings of said handle unit being located adjacent to the first end of said outer shaft, (3) a drive shaft located in the bore of the body of said handle unit and including (A) a first end located adjacent to the first end of the body of said handle unit, and (B) a second end connected to the first end of the inner shaft of said drive unit so the inner shaft of said shaft unit rotates with the drive shaft of said handle unit as the drive shaft of said handle unit is rotated, and (C) a drive socket rotatably mounted on the first end of the body of said handle unit and including (i) a first end located inside the bore of the body of said handle unit and connected to the first end of the drive shaft of said handle unit so the drive shaft of said handle unit rotates with the drive socket as the drive socket is rotated, and (ii) a second end located adjacent to the first end of the body of said handle unit, the second end of the drive socket being located outside the bore of the body of said handle unit, and (4) knurling on the outside surface of the body of said handle unit; and c) a drive head unit including (1) a body having (A) a first portion which includes i) a first end, (ii) a second end, (iii) first and second sides connecting the first end of the first portion of the body of said drive head unit to the second end of the first portion of the body of the drive head unit, (iv) a longitudinal dimension extending between the first end of the first portion of the body of said drive head unit to the second end of the first portion of the body of said drive head unit, and (v) a bore extending along the longitudinal dimension of the first portion of the body of said drive head unit from the first end of the first portion of the body of said drive head unit to the second end of the first portion of the body of said drive head unit, and (B) a second portion on the second side of the first portion of the body and which includes an inner chamber, (2) the inner shaft of said shaft unit extending into the bore of the first portion of the body of said drive unit and is mounted for rotation in the first portion of the body of said drive unit, said worm gear being positioned on the inner shaft of said drive shaft unit to be located inside the bore of the first portion of the body of said drive head unit, (3) bushings connecting the inner shaft of said shaft unit to the body of the first portion of said drive head unit in a manner that permits the inner shaft of said shaft unit to rotate with respect to the first portion of the body of said drive head unit, (4) the second end of the outer shaft of said shaft unit being located adjacent to the first end of the body of the first portion of said drive head unit, (5) a pivot joint connecting the first portion of the body of said drive head unit to the inner shaft of said shaft unit in a manner which permits the inner shaft of said shaft unit to rotate with respect to the first portion of the body of said drive head unit and permits the first portion of the body of said drive head unit to pivot with respect to the inner shaft of said shaft unit between a first position having the first side of the first portion of the body of said drive head unit located adjacent to one portion of the outer shaft of said shaft unit and a second position having the second side of the first portion of the first portion of the body of said drive head unit located adjacent to a second portion of the outer drive shaft of said shaft unit, with the first portion of the portion of the outer drive shaft of said shaft unit being spaced apart from the second portion of the outer drive shaft of said shaft unit, and said the first portion of the body of said drive head unit pivoting about an axis that is perpendicular to a plane containing the outer shaft of said shaft unit, (6) a bushing on the second end of the body of the first portion of said drive head unit and which engages the second end of the inner shaft of said shaft unit, (7) a toothed gear in the inner chamber of the second portion of the body of said drive head unit and positioned to engage the worm gear of said shaft unit for rotation therewith as the worm gear rotates, the toothed gear of said drive head unit having an axis of rotation that is perpendicular to the plane containing the inner shaft of said shaft unit, and (8) a socket connector fixedly connected to the toothed gear of said drive head unit for rotation therewith as the toothed gear rotates.

2. The wrench as described in claim 1 wherein the socket connector of said drive head unit is a male socket connector.

3. The wrench as described in claim 1 wherein the drive socket of said handle unit is a female socket.

4. The wrench as described in claim 3 wherein the drive socket of said handle unit is square in shape.

5. The wrench as described in claim 1 wherein the bushings in said handle unit are constructed of nylon.

6. The wrench as described in claim 5 wherein the bushings in said shaft unit are constructed of brass.

7. The wrench as described in claim 1 wherein the first position of the first portion of the body of said drive head unit is spaced from the second position of the first portion of the body of said drive head unit by 90 arc- degrees.

8. The wrench as described in claim 1 wherein the pivot joint of said drive head unit includes pivot pins.

9. The wrench as described in claim 1 wherein the first end of the drive shaft of said drive head unit is connected to the first end of the body of said handle unit.

10. A wrench comprising:

a) a shaft unit which includes an inner shaft and an outer shaft, with the inner and outer shafts being triangular, said shaft unit including a longitudinal direction;

b) a handle unit that is attached to said shaft unit to rotate the inner shaft of said shaft unit about the longitudinal direction and is movable along the longitudinal direction of said shaft unit; and c) a drive head unit mounted on said shaft unit and including a pivot connection to pivotally connect said drive head unit to said shaft unit, said pivot connection including a pivot axis that is perpendicular to the longitudinal direction of said shaft unit;

d) a drive socket mounted on said drive head unit; and e) a driving connection coupling the inner shaft of said shaft unit to said drive socket to transfer rotation of the inner shaft of said shaft unit to said drive socket.

11. The wrench as described in claim 10, wherein said drive head moves in a direction that differs from the direction of rotation of said inner shaft whereby the wrench has a plurality of degrees of freedom.

* * * * *